US010322326B2

(12) United States Patent
Mizutani et al.

(10) Patent No.: US 10,322,326 B2
(45) Date of Patent: Jun. 18, 2019

(54) GOLF CLUB HOSEL DETACHABLY COUPLED IN A PLURALITY OF ROTATION POSITIONS

(71) Applicant: SUMITOMO RUBBER INDUSTRIES, LTD., Kobe-shi, Hyogo (JP)

(72) Inventors: Naruhiro Mizutani, Kobe (JP); Kiyofumi Matsunaga, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 232 days.

(21) Appl. No.: 15/026,859

(22) PCT Filed: Oct. 2, 2014

(86) PCT No.: PCT/JP2014/076390
§ 371 (c)(1),
(2) Date: Apr. 1, 2016

(87) PCT Pub. No.: WO2015/050195
PCT Pub. Date: Apr. 9, 2015

(65) Prior Publication Data

US 2016/0310805 A1 Oct. 27, 2016

(30) Foreign Application Priority Data

Oct. 3, 2013 (JP) ..... 2013-208114

(51) Int. Cl.
*A63B 53/04* (2015.01)
*A63B 60/00* (2015.01)
(Continued)

(52) U.S. Cl.
CPC ..... *A63B 60/00* (2015.10); *A63B 53/02* (2013.01); *A63B 53/04* (2013.01);
(Continued)

(58) Field of Classification Search
CPC ..... A63B 53/02; A63B 2053/022; A63B 2053/023; A63B 2053/024;
(Continued)

(56) References Cited

U.S. PATENT DOCUMENTS 5,228,689 A * 7/1993 Donofrio, Sr. ..... A63B 53/06 473/245
5,253,869 A * 10/1993 Dingle ..... A63B 53/02 473/245
(Continued)

FOREIGN PATENT DOCUMENTS

CN 102527005 A 7/2012
JP 2007-229057 A 9/2007
(Continued)

OTHER PUBLICATIONS

Japanese Office Action issued in Japanese Application No. 2013-208114, dated Apr. 4, 2017, together with an English translation.
(Continued)

*Primary Examiner* — William M Pierce
(74) *Attorney, Agent, or Firm* — Birch, Stewart, Kolasch & Birch LLP

(57) ABSTRACT

In a golf club according to one aspect of the present invention, a first coupling portion of a first adapter, to which the shaft is fixed, and a hosel first coupling portion of the golf club head are coupled so as to be incapable of axial rotation, and thus the shaft is attached to the golf club head so as to not be capable of axial rotation. Accordingly, the second adapter coupled to the first adapter at least does not need to be configured so as to be incapable of axial rotation, thus making it possible to increase the degree of freedom in adapter design.

14 Claims, 18 Drawing Sheets

(51) Int. Cl.
*A63B 53/02* (2015.01)
*A63B 71/06* (2006.01)

(52) U.S. Cl.
CPC .... *A63B 53/0466* (2013.01); *A63B 2053/022* (2013.01); *A63B 2071/0694* (2013.01)

(58) Field of Classification Search
CPC ..... A63B 2053/025; A63B 2053/026; A63B 2053/027; A63B 2053/028
See application file for complete search history.

(56) References Cited

U.S. PATENT DOCUMENTS 5,390,919 A * 2/1995 Stubbs ..... A63B 53/065 473/246
6,381,828 B1 * 5/2002 Boyce ..... A63B 53/02 148/669
6,390,933 B1 * 5/2002 Galloway ..... A63B 53/02 473/290
6,398,666 B1 * 6/2002 Evans ..... A63B 53/02 473/345
8,753,221 B1 * 6/2014 Aguinaldo ..... A63B 53/02 473/246
9,808,679 B1 * 11/2017 Seluga ..... A63B 53/02
2008/0254908 A1 10/2008 Bennett et al.
2009/0197696 A1 * 8/2009 Tsai ..... A63B 53/02 473/306
2009/0197697 A1 * 8/2009 Tsai ..... A63B 53/02 473/306
2009/0286618 A1 11/2009 Beach et al.
2010/0069170 A1 3/2010 Bennett et al.
2010/0197423 A1 8/2010 Thomas et al.
2011/0098127 A1 4/2011 Yamamoto
2012/0100926 A1 4/2012 Golden et al.
2012/0165111 A1 6/2012 Cheng
2012/0231896 A1 9/2012 Seluga et al.
2013/0017901 A1 * 1/2013 Sargent ..... A63B 53/0466 473/309
2013/0059676 A1 * 3/2013 Boyd ..... A63B 53/02 473/307
2013/0196784 A1 * 8/2013 Clausen ..... A63B 53/02 473/242
2013/0344988 A1 * 12/2013 Hettinger ..... A63B 53/047 473/349
2014/0080617 A1 * 3/2014 Llewellyn ..... A63B 53/0466 473/246
2014/0080622 A1 * 3/2014 Sargent ..... A63B 53/0466 473/307
2014/0121035 A1 * 5/2014 Nivanh ..... A63B 53/00 473/309
2014/0162805 A1 * 6/2014 Kitagawa ..... A63B 53/02 473/307
2015/0038253 A1 * 2/2015 Mizutani ..... A63B 53/02 473/307
2015/0217364 A1 * 8/2015 Zimmerman ..... B21K 17/00 72/352
2015/0231452 A1 * 8/2015 Boggs ..... A63B 53/02 473/307
2015/0231453 A1 * 8/2015 Harbert ..... A63B 53/02 473/307
2016/0045791 A1 * 2/2016 Galvan ..... A63B 53/02 473/307
2016/0059093 A1 * 3/2016 Nielson ..... A63B 53/02 473/338
2016/0184662 A1 * 6/2016 Barelmann ..... A63B 53/02 473/307
2018/0065009 A1 * 3/2018 Sargent ..... A63B 53/06

FOREIGN PATENT DOCUMENTS

JP 2009-148560 A 7/2009
JP 2009-291602 A 12/2009
JP 2011-62523 A 3/2011
JP 2011-92223 A 5/2011
JP 2013-500059 A 1/2013

OTHER PUBLICATIONS

Chinese Office Action and Search Report, dated Jun. 28, 2017, for Chinese Application No. 201480053802.7, with English translation.
International Search Report, issued in PCT/JP2014/076390, dated Dec. 22, 2014.
Written Opinion of the International Searching Authority, issued in PCT/JP2014/076390 (PCT/ISA/237), dated Dec. 22, 2014.
Japanese Office Action, dated Nov. 28, 2017, for Japanese Application No. 2013-208114, along with an English translation.
Chinese Office Action, dated Apr. 3, 2018, for Chinese Application No. 201480053802.7, along with an English translation.

* cited by examiner

GOLF CLUB HOSEL DETACHABLY COUPLED IN A PLURALITY OF ROTATION POSITIONS

TECHNICAL FIELD

The present invention relates to a golf club.

BACKGROUND ART

Various methods of coupling a golf club head and a shaft have been proposed in recent years. For example, Patent Literature 1 discloses a golf club in which two adapters are attached between the hosel portion of the golf club head and the shaft so as to make it possible to change the angle of attachment of the shaft to the golf club head.

Specifically, the golf club disclosed in Patent Literature 1 is configured as follows. First, a shaft adapter attached to the shaft is fixed so as to be inclined relative to the shaft. Ahead adapter attached to the hosel portion is removably attached to the head at one of multiple rotation positions. The shaft adapter is then fitted into the head adapter at an inclined angle relative thereto, and furthermore can be fitted therein at multiple rotation positions.

Accordingly, the shaft can be attached to the golf club head at various angles by adjusting the rotation position of the head adapter relative to the hosel portion and the rotation position of the shaft adapter relative to the head adapter. This makes it possible to adjust the lie angle, loft angle, and face angle of the golf club to suit the user's preference.

CITATION LIST

Patent Literature

Patent Literature 1: JP 2013-500059A

SUMMARY OF INVENTION

Technical Problem

However, in the golf club described above, the head adapter is fitted into the hosel portion, and the shaft adapter is fitted into the head adapter, thus fixing the shaft so as to be incapable of axial rotation. For this reason, there has been a problem in that the shapes of the two adapters are limited to shapes that prevent axial rotation of the shaft.

One aspect of the present invention has been achieved in consideration of this point, and an object thereof is to make it possible to increase the degree of freedom in adapter design.

Solution to Problem

A golf club according to one aspect of the present invention includes: a shaft; a golf club head having a hosel portion that includes an attachment hole for attachment of the shaft, a hosel first coupling portion provided on a peripheral edge of the attachment hole, a hosel second coupling portion provided on a side opposite to the attachment hole, and a first opening portion that is formed on a side opposite to the attachment hole of the hosel portion and is in communication with an interior space of the hosel portion; a first adapter that is accommodated in the interior space of the hosel portion from an attachment hole side and has a first end portion and a second end portion, the first adapter having a shaft receiving recessed portion to which the shaft is to be fixed and that is open on a first end portion side, a first coupling portion that is provided on the first end portion side and is coupled to the hosel first coupling portion of the golf club head so as to be incapable of axial rotation, and a second coupling portion provided on a second end portion side; a second adapter that is accommodated in the interior space of the hosel portion from a first opening portion side and has a first end portion and a second end portion, the second adapter having a first coupling portion that is provided on a first end portion side and is coupled to the second coupling portion of the first adapter, and a second coupling portion that is coupled to the hosel second coupling portion of the golf club head; and a fixing member that detachably fixes the first adapter and the second adapter from a second end portion side of the second adapter. Also, the second coupling portion of the first adapter is formed along a first axis, and the shaft receiving recessed portion of the first adapter is formed along a second axis that intersects the first axis of the first adapter, such that the shaft is fixed to the shaft receiving recessed portion so as to be inclined relative to the second coupling portion of the first adapter, the second coupling portion of the second adapter is formed along a first axis, and the first coupling portion of the second adapter is formed along a second axis that intersects the first axis of the second adapter, such that the second coupling portion of the first adapter is coupled to the first coupling portion of the second adapter so as to be inclined relative to the second coupling portion of the second adapter, the first coupling portion of the first adapter and the hosel first coupling portion of the golf club head can be detachably coupled in a plurality of rotation positions, and the second coupling portion of the first adapter and the first coupling portion of the second adapter can be detachably coupled in a plurality of rotation positions.

Also, as another mode of the golf club according to the above aspect, a second opening portion that is in communication with the interior space of the hosel portion and exposes at least a portion of an outer peripheral surface of the second adapter to the outside may be formed in a front surface of the golf club head. Furthermore, a position indication portion for indicating a rotation position may be provided on a portion of the second adapter that is exposed through the second opening portion.

Also, as another mode of the golf club according to the above aspect, the first adapter may be formed with a tube shape along the first axis of the first adapter such that the first end portion and the second end portion of the first adapter are located on the first axis of the first adapter. Furthermore, the second adapter may be formed with a tube shape along the first axis of the second adapter such that the first end portion and the second end portion of the second adapter are located on the first axis of the second adapter. Moreover, the first coupling portion of the first adapter and the hosel first coupling portion of the golf club head may be able to be coupled in a plurality of rotation positions about the first axis of the first adapter, and the second coupling portion of the first adapter and the first coupling portion of the second adapter may be able to be coupled in a plurality of rotation positions about the second axis of the second adapter.

Also, as another mode of the golf club according to the above aspect, the second coupling portion of the first adapter may be configured by an outer peripheral surface having formed thereon a plurality of projections that extend in a direction of the first axis of the first adapter. Furthermore, the first coupling portion of the second adapter may be configured by an inner peripheral surface having formed therein a plurality of grooves that extend in a direction of the second axis of the second adapter and correspond to the plurality of projections so as to receive insertion of the plurality of projections. Moreover, the second coupling portion of the first adapter and the first coupling portion of the second adapter may be able to be coupled so as to be incapable of axial rotation in a plurality of rotation positions due to engagement of the plurality of projections of the first adapter and the plurality of grooves of the second adapter.

Also, as another mode of the golf club according to the above aspect, the second coupling portion of the second adapter may be configured by an outer peripheral surface formed with a polygonal shape, and the hosel second coupling portion of the golf club head may be configured by a polygonal inner wall surface on a first opening portion side so as to receive and engage with the second coupling portion of the second adapter, such that the second coupling portion of the second adapter and the hosel second coupling portion of the golf club head can be coupled so as to be incapable of axial rotation.

Also, as another mode of the golf club according to the above aspect, the golf club may further include a cover member that detachably closes the first opening portion.

Also, as another mode of the golf club according to the above aspect, a through-hole for insertion of a tool that can operate the fixing member may be formed in the cover member.

Also, as another mode of the golf club according to the above aspect, the first adapter may further have a position indication portion for indicating a rotation position on the first end portion side of the first adapter.

Advantageous Effects of Invention

According to the present invention, the first coupling portion of the first adapter, to which the shaft is fixed, and the hosel first coupling portion of the golf club head are coupled so as to be incapable of axial rotation, and therefore the shaft is attached to the golf club head so as to be incapable of axial rotation. For this reason, at least the second adapter does not need to be configured so as to be incapable of axial rotation. Accordingly, the golf club according to an aspect of the present invention makes it possible to increase the degree of freedom in adapter design.

REFERENCE SIGNS LIST

Figure 1:
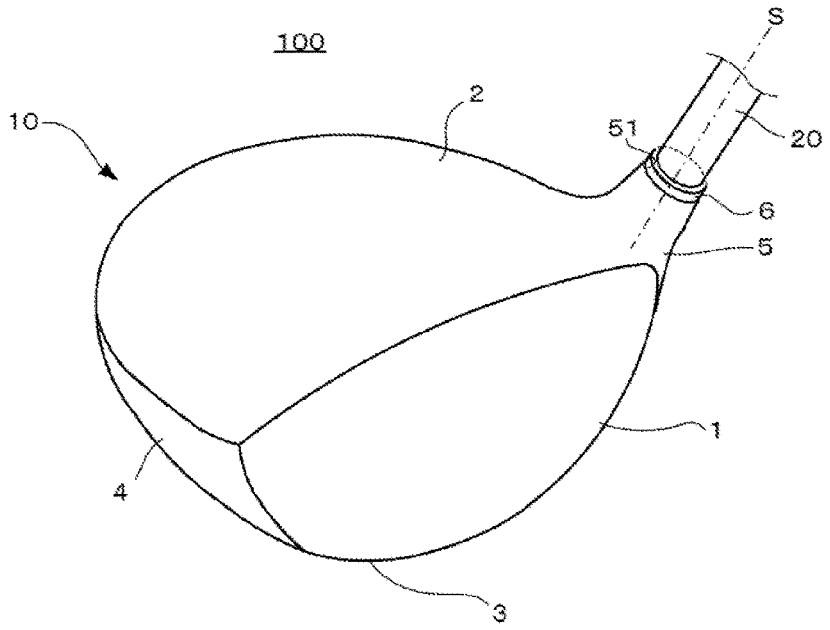
FIG. 1 is a perspective view illustrating an overall structure of a golf club according to an embodiment.

10 Golf club head
20 Shaft
5 Hosel portion
501 First diameter portion (hosel first coupling portion)
6 First adapter
613 First coupling portion
7 Second adapter
9 Fastener (fixing member)

DESCRIPTION OF EMBODIMENTS

An embodiment of a golf club according to the present invention will be described below with reference to the drawings.

Note that although the following description uses the orientation shown in the drawings as a reference, this is for the sake of convenience in the description, and this orientation is not intended to limit the invention. Also, the axial direction in the following description is generally the direction in which the shaft extends unless otherwise stated, and is not intended to have a strict definition.

1. Overall Structure of Golf Club

First, the overall structure of the golf club will be described using FIGS. 1 and 2. FIG. 1 is a perspective view illustrating the overall structure of a golf club 100 according to the present embodiment. Also, FIG. 2 is a plan view illustrating a golf club head 10 according to the present embodiment.

Figure 2:
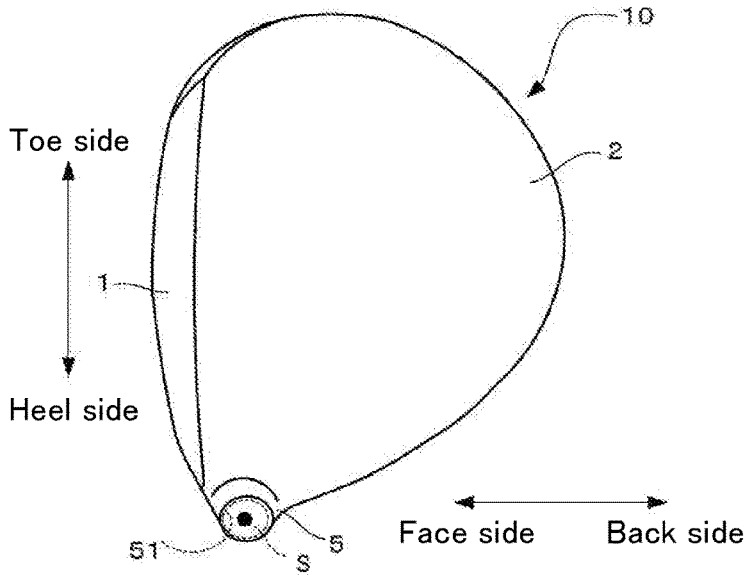
FIG. 2 is a plan view illustrating a golf club head according to the embodiment.

As illustrated in FIGS. 1 and 2, the golf club 100 according to the present embodiment includes a shaft 20 and a golf club head 10 (hereinafter, sometimes simply called the "head") coupled to the end portion of the shaft 20. Also, the shaft 20 and the golf club head 10 are coupled together by a later-described coupling structure, and are configured such that it is possible to change the axial rotation position of the shaft 20 relative to the head 10. These members will be described in detail below.

The shaft 20 is shaped as a hollow tube, has a lower end portion to which the above-mentioned golf club head 10 is coupled, and has an upper end portion to which a grip (not shown) is fixed.

The golf club head 10 is a hollow structure and has outer surfaces formed by a face portion 1, a crown portion 2, a sole portion 3, a side portion 4, and a hosel portion 5. The face portion 1 has a face surface, which is the surface for hitting a golf ball. The crown portion 2 is adjacent to the face portion 1 and constitutes the upper surface of the head 10. The sole portion 3 constitutes the bottom surface of the head 10, and is adjacent to the face portion 1 and the side portion 4. Also, the side portion 4 is the portion between the crown portion 2 and the sole portion 3, and extends from the toe side of the face portion 1, across the back side of the head 10, to the heel side of the face portion 1.

Furthermore, the hosel portion 5 is a cylindrical portion provided adjacent to the heel side of the crown portion 2, and has an attachment hole 51 for the attachment of the shaft 20. Specifically, a later-described first adapter 6, which is fixed to the lower end portion of the shaft 20, is inserted into the attachment hole 51. Note that although the head 10 described here is a wood head such as a driver (#1) or fairway wood head, it is not limited to being a wood head, and may be a so-called utility head, hybrid head, or the like.

2. Coupling Structure for Coupling Shaft and Golf Club Head

Figure 3:
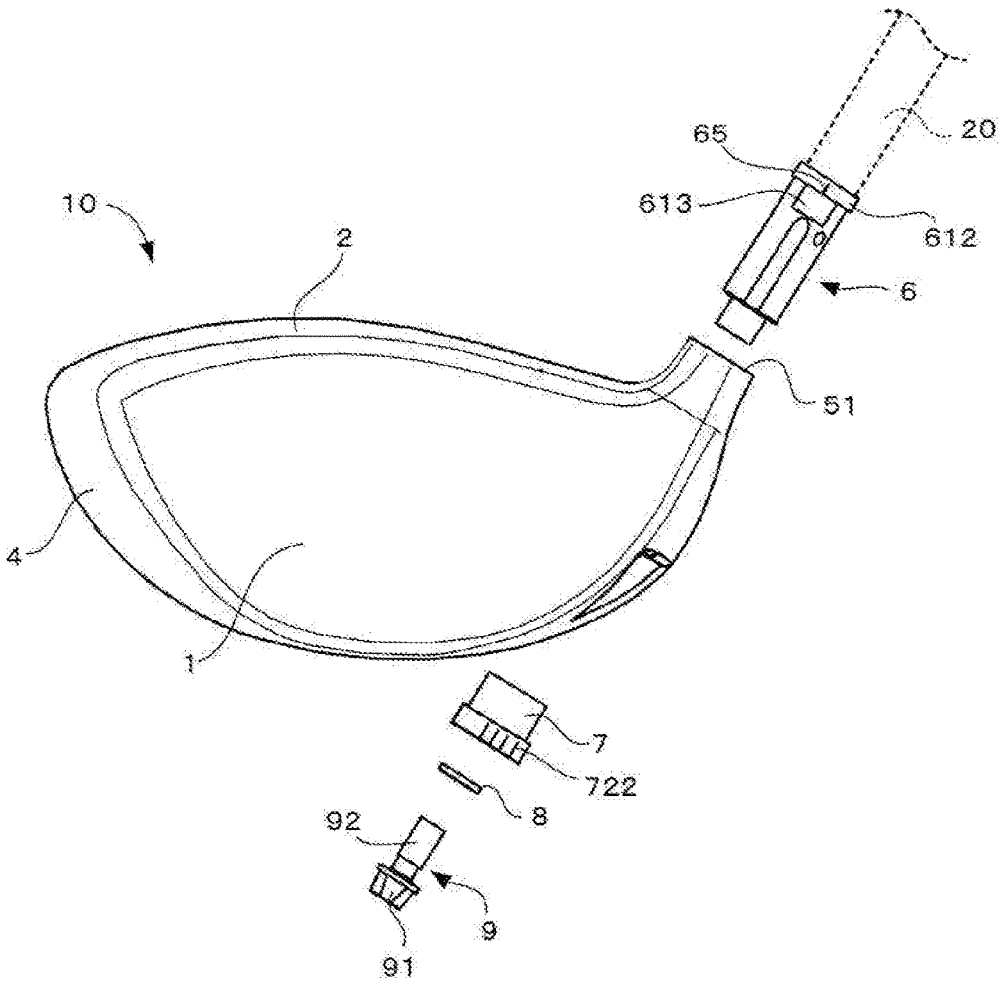
FIG. 3 is an exploded view illustrating a coupling structure for coupling the golf club head and a shaft according to the embodiment.

Next, the coupling structure for coupling the shaft 20 and the golf club head 10 will be described using FIG. 3. FIG. 3 is an exploded view illustrating the coupling structure for coupling the shaft 20 and the golf club head 10. As illustrated in this figure, the shaft 20 and the golf club head 10 are coupled via the first adapter 6 and a second adapter 7. The first adapter 6 and the second adapter 7 are fixed inside the golf club head 10 by a washer 8 and a fastener 9 (which correspond to a fixing member of the present invention). This coupling structure will be described in detail below.

2.1 Coupling-Related Structure of Golf Club Head

Figure 4:
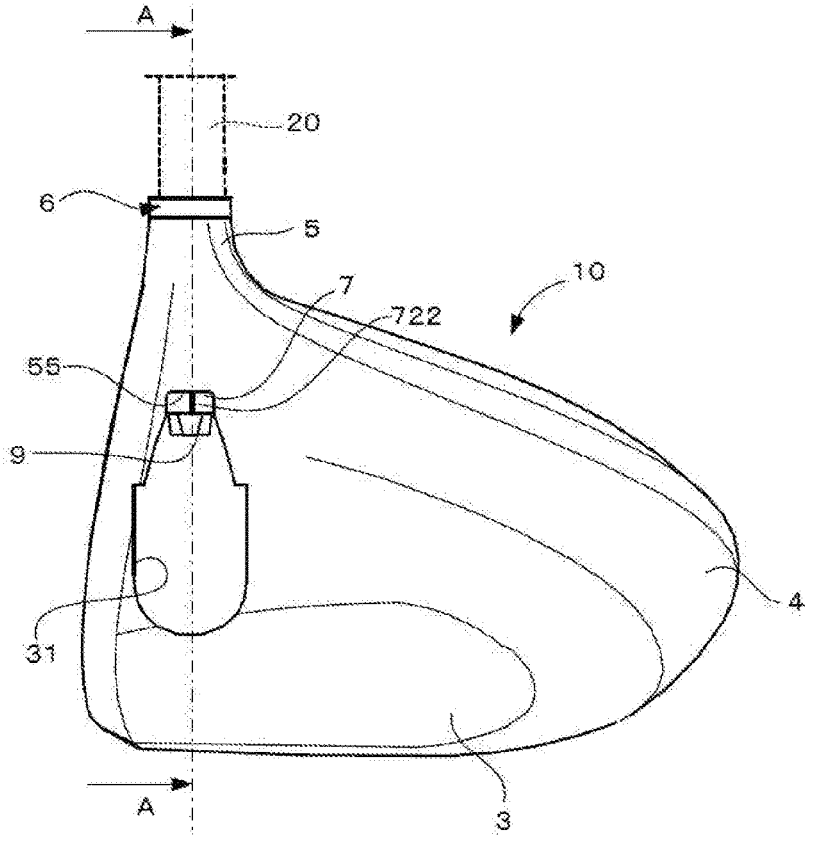
FIG. 4 is a front view illustrating a state of the golf club head with a first adapter, a second adapter, a washer, and a fastener mounted thereto, as viewed from the heel side.
Figure 5:
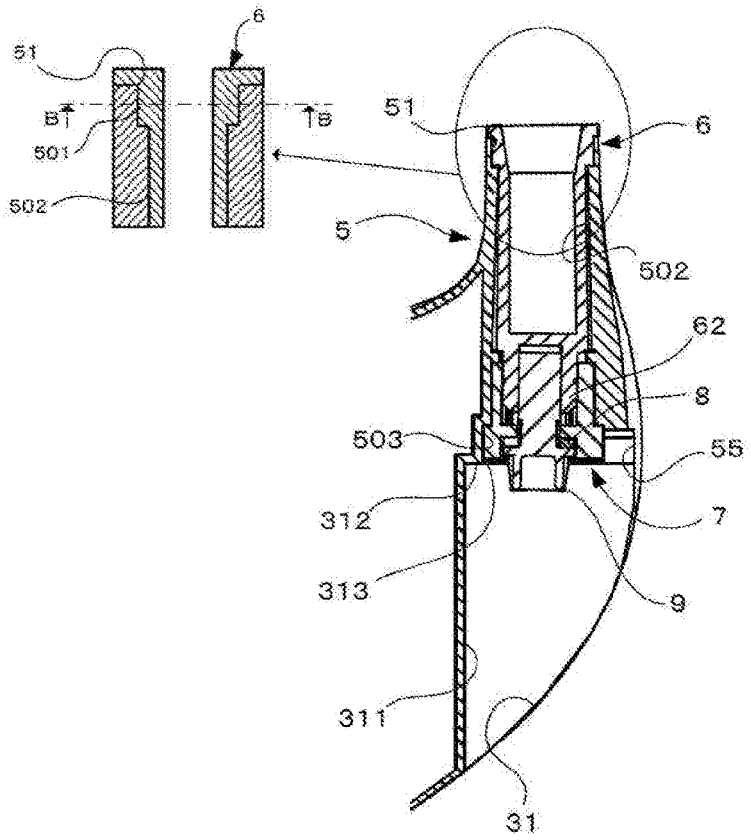
FIG. 5 illustrates a cross-section taken along line A-A in FIG. 4.
Figure 6:
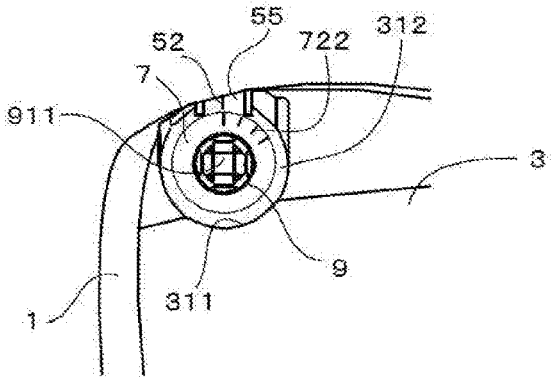
FIG. 6 is a bottom view of the golf club head illustrated in FIG. 4, as viewed from the sole portion side.
Figure 7:
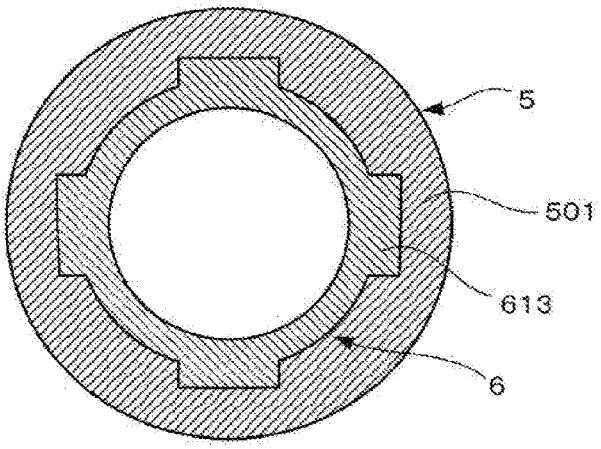
FIG. 7 illustrates a cross-section taken along line B-B in FIG. 5.

First, the structure of the golf club head 10 will be described using FIGS. 4 to 7. FIG. 4 is a front view illustrating a state of the golf club head 10 with the first adapter 6, the second adapter 7, the washer 8, and the fastener 9 mounted thereto, as viewed from the heel side. FIG. 5 is a cross-sectional view illustrating a cross-section taken along A-A in FIG. 4. FIG. 6 is a bottom view illustrating a state of the golf club head 10 illustrated in FIG. 4, as viewed from the sole portion 3 side. FIG. 7 is a cross-sectional view illustrating a cross-section taken along B-B in FIG. 5.

As illustrated in FIGS. 4 to 6, the interior space of the hosel portion 5 extends to the side portion 4 side and the sole portion 3 side in a direction approximately parallel to the axial direction of the shaft 20. A recessed portion 31 is formed in a portion of the sole portion 3 on the side opposite to the attachment hole 51 of the hosel portion 5. This recessed portion 31 is constituted by an arc-shaped side surface 311 that extends approximately parallel to the interior space of the hosel portion 5, and a base surface 312 that extends approximately perpendicularly from the side surface 311. Also, a lower opening 313 that is in communication with the interior space of the hosel portion 5 is formed in the base surface 312. The lower opening 313 corresponds to a first opening portion of the golf club head of the present invention.

Also, a rectangular window 55 in communication with the interior space of the hosel portion 5 is formed on the attachment hole 51 side relative to the base surface 312. The window 55 corresponds to a second opening portion of the golf club head of the present invention. The window 55 is formed by cutting out a portion of the base surface 312 and the side portion 4 so as to expose a portion of the interior space of the hosel portion 5 (a third diameter portion 503 that will be described later) to the outside. For this reason, when the later-described second adapter 7 is arranged in the interior space of the hosel portion 5, a portion of the second adapter 7 is exposed through the window 55.

As shown in the enlarged view in FIG. 5, the interior space of the hosel portion 5 according to the present embodiment is constituted by a first diameter portion 501, a second diameter portion 502, and a third diameter portion 503, in order from the attachment hole 51 side. The first diameter portion 501 is provided on the inner peripheral edge of the attachment hole 51, and has multiple rectangular depressions along the inner peripheral edge. The first diameter portion 501 will be described below using FIG. 7.

FIG. 7 is a cross-sectional view illustrating a cross-section taken along B-B in FIG. 5. As illustrated in FIG. 7 and the enlarged view in FIG. 5, multiple protrusion portions provided on the outer peripheral surface of a first coupling portion 613 of the later-described first adapter 6 engage with the depressions of the first diameter portion 501. Accordingly, the first adapter 6 (shaft 20) and the hosel portion 5 (head 10) are coupled so as to be incapable of axial rotation. In other words, the first diameter portion 501 corresponds to a hosel first coupling portion of the present invention. Note that the term "coupled" here need only mean that at least two things are in contact so as to be immobile, and it is not required that the two things do not separate even when external force is applied. The same applies for the term "couple" used hereinafter.

Returning to FIG. 5, the second diameter portion 502 and the third diameter portion 503 will be described next. The second diameter portion 502 is continuous with the first diameter portion 501 and is formed with a cylindrical shape. Specifically, the second diameter portion 502 is formed with a tapered shape in which the diameter somewhat increases as it extends toward the third diameter portion 503 side. The third diameter portion 503 is continuous with the second diameter portion 502 and is formed with a cylindrical shape having a larger diameter than the second diameter portion 502. Also, the third diameter portion 503 is in communication with the lower opening 313. The opening of the third diameter portion 503 on the lower end portion side is provided so as to match the lower opening 313.

During assembly, the first adapter 6 is inserted into the first diameter portion 501 and the second diameter portion 502 from the attachment hole 51 side. Also, the second adapter 7 is inserted into the third diameter portion 503 from the lower opening 313 side. The first adapter 6 and the second adapter 7 are thus detachably coupled in the interior space of the hosel portion 5, and are removably fixed by the washer 8 and the screw-like fastener 9.

As illustrated in FIG. 3, the fastener 9 is formed by a head portion 91 and a threaded portion 92 that is coupled to the head portion 91. A rectangular recessed portion 911 (see FIGS. 5 and 6) for insertion of a wrench is formed in the head portion 91. By fitting a wrench into the recessed portion 911 and operating it, a user can fasten and detach the first adapter 6 and the second adapter 7.

Note that when the first adapter 6 and the second adapter 7 have been fixed by the washer 8 and the screw-like fastener 9, the fastening force of the fastener 9 couples a flange portion 72 of the later-described second adapter 7 to a step formed in the coupling portion between the second diameter portion 502 and the third diameter portion 503. In other words, the step formed in the coupling portion between the second diameter portion 502 and the third diameter portion 503 corresponds to a hosel second coupling portion of the present invention.

2.2 First Adapter

Figure 8A:
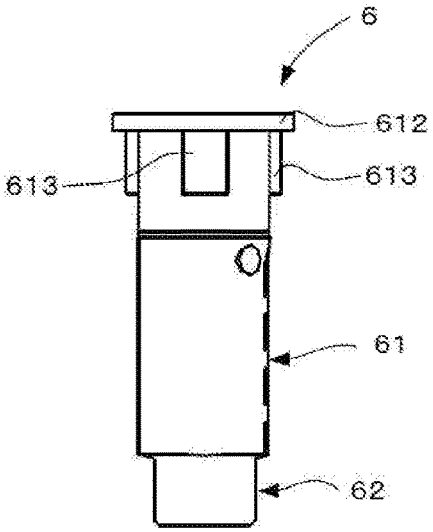
FIG. 8A is a side view illustrating the first adapter according to the embodiment.

Next, the first adapter 6 will be described using FIGS. 8A and 8B. FIG. 8A is a side view illustrating the first adapter 6 according to the present embodiment. Also, FIG. 8B is a cross-sectional view illustrating the first adapter 6 according to the present embodiment.

Figure 8B:
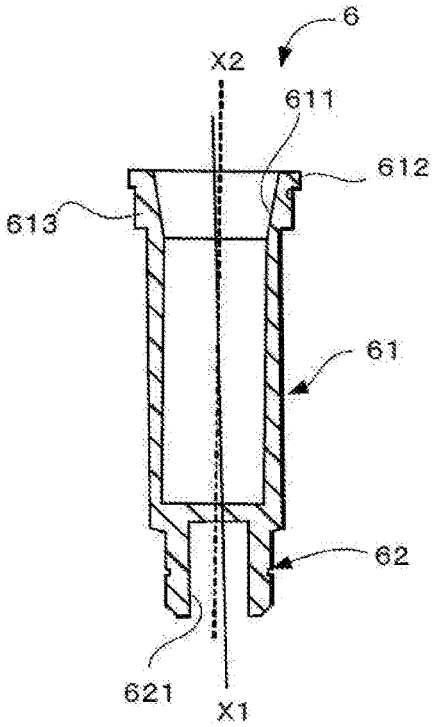
FIG. 8B is a cross-sectional view illustrating the first adapter according to the embodiment.

As illustrated in FIGS. 8A and 8B, the first adapter 6 includes a body portion 61 formed in a tubular shape. The body portion 61 has a first axis X1 (solid line in FIG. 8B) as its axial center, has an external shape that extends in a cylindrical manner along the first axis X1, and has a shaft receiving recessed portion 611 that is open on the upper end portion side. The shaft receiving recessed portion 611 has a cylindrical inner wall surface that extends along a second axis X2 (dashed line in FIG. 8B) that intersects the first axis X1 with an angle of approximately 1 degree, and the lower end portion of the shaft 20 is inserted into the shaft receiving recessed portion 611. The shaft 20 is fixed to the shaft receiving recessed portion 611 by a fixing means such as adhesion. Accordingly, the shaft 20 is fixed such that an axial center S (see FIG. 1) thereof extends along the second axis X2 of the first adapter 6 and extends at an inclination from the first axis X1 of the first adapter 6.

Also, the outer diameter of the body portion 61 of the first adapter 6 is smaller than the attachment hole 51 of the hosel portion 5, but a flange portion 612 that extends outward in the diameter direction with a larger diameter than the attachment hole 51 is formed on the outer peripheral surface of the body portion 61 on the upper end side, and a first coupling portion 613 having multiple protrusion portions with a smaller diameter than the flange portion 612 is formed on the lower surface of the flange portion 612.

The flange portion 612 comes into contact with the peripheral edge of the attachment hole 51 of the hosel portion 5. Also, the first coupling portion 613 is formed below the flange portion 612, and is used to couple the first adapter 6 and the hosel portion 5. Specifically, the protrusion portions of the first coupling portion 613 engage with the depressions of the first diameter portion 501 of the hosel portion 5, thus coupling the first adapter 6 and the hosel portion 5 so as to be incapable of axial rotation.

Note that the first adapter 6 is fixed at one of the rotation positions with an inclination relative to the later-described second adapter 7. For this reason, the protrusion portions formed on the first coupling portion 613 of the first adapter 6 are formed somewhat smaller than the depressions formed on the first diameter portion 501 of the hosel portion 5 such that the first adapter 6 does not interfere with the inner wall surface of the first diameter portion 501 regardless of the rotation position at which the first adapter 6 is fixed to the second adapter 7.

Due to the first adapter 6 being attached to the hosel portion 5 in this way, the first adapter 6 is accommodated in the interior space of the hosel portion 5 in a state in which the flange portion 612 is arranged outside the attachment hole 51, and the portion below the flange portion 612 is arranged in the interior space of the hosel portion 5. In other words, the term "accommodate" used here need only mean that at least a portion of something is inside the interior space, and there is not necessarily a requirement for all portions to be inside the interior space. The same applies for the term "accommodate" used hereinafter.

Note that the number of protrusion portions on the first coupling portion 613 and the number of depressions in the first diameter portion 501 are not particularly limited, but are each four in the present embodiment. For this reason, the first adapter 6 can be fitted into the hosel portion 5 in four rotation positions. For example, as illustrated in FIG. 4, a position indication portion 65 for displaying the rotation position is provided on the outer peripheral surface of the flange portion 612. The user can set the head 10 at a desired angle, as will be described later, by selecting the rotation position of the first adapter 6 while referencing the position indication portion 65.

Also, as illustrated in FIGS. 8A and 8B, the first adapter 6 includes a tube-shaped second coupling portion 62 that is formed as a single body with the lower end portion of the body portion 61 and has a smaller diameter than the body portion 61. The second coupling portion 62 of the first adapter 6 is formed in the shape of a tube that extends along the first axis X1, and has a threaded hole 621 that is open downward. Female threading is formed on the inner wall surface of the threaded hole 621, and the threaded portion 92 of the fastener 9 is screwed therein. On the other hand, the outer peripheral surface of the second coupling portion 62 is smooth, and the second coupling portion 62 is inserted into a later-described recessed portion 711 of the second adapter 7. Note that in FIGS. 8A and 8B, the upper end portion of the first adapter 6 corresponds to a first end portion of the present invention, and the lower end portion of the first adapter 6 corresponds to a second end portion of the present invention.

2.3 Second Adapter

Figure 9A:
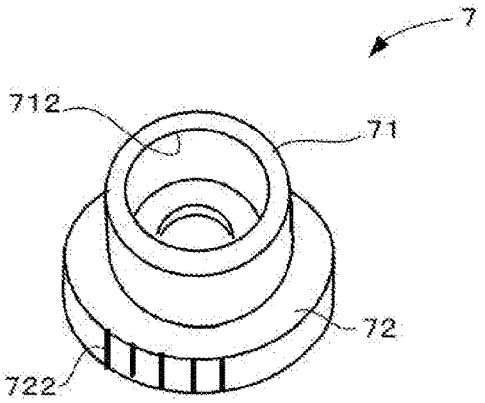
FIG. 9A is a perspective view illustrating a state of the second adapter according to the embodiment, as viewed from above.
Figure 9B:
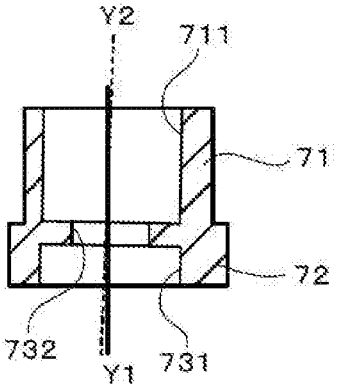
FIG. 9B is a cross-sectional view illustrating the second adapter according to the embodiment.
Figure 9C:
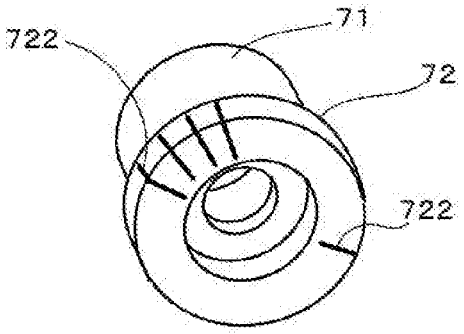
FIG. 9C is a perspective view illustrating a state of the second adapter according to the embodiment, as viewed from below.

Next, the second adapter 7 will be described using FIGS. 9A to 9C. FIG. 9A is a perspective view illustrating a state of the second adapter 7 according to the present embodiment, as viewed from above. FIG. 9B is a cross-sectional view illustrating a cross-section of the second adapter 7 according to the present embodiment. FIG. 9C is a perspective view illustrating a state of the second adapter 7 according to the present embodiment, as viewed from below.

As illustrated in FIGS. 9A to 9C, the second adapter 7 includes a cylindrical body portion 71. The body portion 71 has a first axis Y1 (solid line in FIG. 9B) as its axial center, has an outer diameter that extends in a cylindrical manner along the first axis Y1, and has a recessed portion 711 that is open on the upper end portion side. The recessed portion 711 has a smooth cylindrical inner wall surface that extends along a second axis Y2 (dashed line in FIG. 9B) that intersects the first axis Y1 at an angle of approximately 1 degree, and the second coupling portion 62 of the first adapter 6 is removably inserted into this recessed portion 711. In other words, the recessed portion 711 corresponds to a first coupling portion of the second adapter of the present invention.

According to this configuration, the second coupling portion 62 of the first adapter 6 attached to the recessed portion 711 extends along the second axis Y2 of the second adapter 7, and thus the first adapter 6 is fixed so as to extend at an inclination from the second adapter 7. Here, the axial center of the second coupling portion 62 of the first adapter 6 is the first axis X1 of the first adapter 6, and the shaft 20 is fixed to the first adapter 6 along the second axis X2 of the first adapter 6. For this reason, with the golf club 100 of the present embodiment, the user can adjust the attachment angle of the shaft 20 in two stages using the first adapter 6 and the second adapter 7.

Also, as illustrated in FIGS. 9A to 9C, the second adapter 7 includes a cylindrical flange portion 72 that is integrally coupled to the lower end of the body portion 71 and has a larger diameter than the body portion 71. The outer peripheral surface of the flange portion 72 is smooth, and the flange portion 72 is fixed to the step between the second diameter portion 502 and the third diameter portion 503 of the hosel portion 5 by the fastening force of the fastener 9, as described above. In other words, the flange portion 72 corresponds to a second coupling portion of the second adapter of the present invention.

Also, a through-hole is formed between the flange portion 72 and the body portion 71. This through-hole is defined by a circular large-diameter portion 731 that is open on the flange portion 72 side and a circular small-diameter portion 732 that is continuous with the large-diameter portion 731 and has a smaller diameter than the large-diameter portion 731, and is also in communication with the recessed portion 711. The previously-mentioned circular washer 8 is arranged in the large-diameter portion 731, and the fastener 9 is arranged therein along with the washer 8. The fastener 9 presses the washer 8 with the head portion 91, and the threaded portion 92 passes through the small-diameter portion 732 and extends into the recessed portion 711. The threaded portion 92 is then screwed to the second coupling portion 62 of the first adapter 6, which has been inserted into the recessed portion 711.

The large-diameter portion 731 is formed such that the surface on which the washer 8 is arranged is orthogonal to the second axis Y2. That is to say, since the first adapter 6 extends along the second axis Y2 when it is coupled to the second adapter 7, the washer 8 and the fastener 9 firmly fix them together along the direction in which the first adapter 6 extends. Note that the upper end portion of the second adapter 7 in FIG. 8B corresponds to a first end portion of the present invention, and the lower end portion of the second adapter 7 corresponds to a second end portion of the present invention.

When the second adapter 7 is fixed in this way, the body portion 71 of the second adapter 7 is arranged in a state of being coupled to the first adapter 6 in the second diameter portion 502 of the interior space in the hosel portion 5 (see FIG. 5). On the other hand, the flange portion 72 of the second adapter 7 is arranged in the third diameter portion 503 in the interior space. The second adapter 7 is accommodated in the interior space of the hosel portion 5 in this state.

When the second adapter 7 is accommodated in the interior space of the hosel portion 5 in this way, the second adapter 7 is coupled to the first adapter 6 and the hosel portion 5 by the fastening force of the fastener 9 as described above. The second coupling portion 62 of the first adapter 6, the recessed portion 711 of the second adapter 7, the third diameter portion 503 of the hosel portion 5, and the flange portion 72 of the second adapter 7 are each not shaped such that the second adapter 7 is fixed so as to be incapable of axial rotation in a predetermined rotation position. For this reason, the second adapter 7 can be fitted into the third diameter portion 503 of the hosel portion 5 in any rotation position.

It should be noted that since each of the above is shaped in such a way, when external axial rotational force is applied to the second adapter 7, it is possible for the second adapter 7 to rotate about the axis even in the state of being fixed by the fastener 9. However, the protrusion portions formed on the first coupling portion 613 of the first adapter 6, to which the shaft 20 is fixed, are engaged with the depressions formed in the first diameter portion 501 of the hosel portion 5, and the first adapter 6 and the hosel portion 5 are coupled so as to be incapable of axial rotation. For this reason, it is envisioned that external axial rotational force generated in normal use of the golf club 100 will be canceled out by this portion. Accordingly, it is envisioned that there is a very low possibility of the second adapter 7 rotating about its axis in normal use of the golf club 100.

Accordingly, the second adapter 7 does not need to be coupled to the hosel portion 5 and the first adapter 6 so as to be incapable of axial rotation, and may be designed with any shape as long as it can be coupled to the hosel portion 5 and the first adapter 6. In other words, according to the present embodiment, it is possible to increase the degree of freedom in adapter design.

Note that a position indication portion 722 for indicating multiple rotation positions is provided on the side surface and the lower end surface of the flange portion 72 of the second adapter 7 of the present embodiment. The position indication portion 722 provided on the lower end surface of the flange portion 72 is exposed through the lower opening 313 and visible to the user through the recessed portion 31. Also, in the present embodiment, a portion of the flange portion 72 is exposed through the above-described window 55. For this reason, the position indication portion 722 provided on the side surface of the flange portion 72 is visible to the user through the window 55. Furthermore, a reference indicator 52 serving as indicator of the rotation position of the second adapter 7 is provided on the side surface of the peripheral edge of the opening of the window 55. The user can determine the rotation position of the second adapter 7 by matching one of the indicators of the position indication portion 722 provided on the second adapter 7 with the reference indicator 52.

Also, the first adapter 6 and the second adapter 7 used in the coupling structure can be formed using various materials, and can be formed using Ti(6-4Ti), Al (Al5052), or the like.

3. Assembly of Shaft and Golf Club Head

Next, a method of assembling the golf club 100 having the above configuration will be described. Specifically, a method for attaching the shaft 20 to the golf club head 10 will be described.

First, the user inserts the first adapter 6, which has the shaft 20 fixed thereto, into the attachment hole 51 of the hosel portion 5 in a state in which the second coupling portion 62 faces downward. At this time, the user appropriately determines the rotation position of the first adapter 6 relative to the hosel portion 5 by referencing the position indication portion 65. The user then fits the first coupling portion 613 of the first adapter 6 into the first diameter portion 501 of the hosel portion 5 in the desired rotation position.

Subsequently, the user inserts the second adapter 7 through the lower opening 313 on the sole portion 3 side. At this time, the user appropriately determines the rotation position of the second adapter 7 relative to the first adapter 6 by referencing the position indication portion 722 and the reference indicator 52. The user then couples the second coupling portion 62 of the first adapter 6 and the recessed portion 711 of the second adapter 7 such that the flange portion 72 is fitted into the third diameter portion 503 of the hosel portion 5 in the desired rotation position.

Lastly, the user arranges the washer 8 in the large-diameter portion 731 of the flange portion 72 of the second adapter 7, and inserts the threaded portion 92 of the fastener 9 into the small-diameter portion 732 and screws it to the second coupling portion 62 of the first adapter 6. Accordingly, the first adapter 6 and the second adapter 7 are fixed in the interior space of the hosel portion 5, and the shaft 20 is attached to the golf club head 10.

When the shaft 20 and the head 10 have been fixed as described above, the shaft 20 is fixed so as to be inclined at an angle of 1 degree relative to the first adapter 6. Also, the first adapter 6 is fixed so as to be inclined at an angle of 1 degree relative to the second adapter 7. Accordingly, the shaft 20 is fixed so as to be inclined at a maximum of 2 degrees relative to the second adapter 7.

In this way, the first adapter 6 is fixed so as to be inclined relative to the second adapter 7 in one of the rotation positions, and since the second diameter portion 502 of the interior space accommodating the first adapter 6 is tapered, the first adapter 6 does not interfere with the inner wall surface of the second diameter portion 502 regardless of the rotation position in which the first adapter 6 is fixed to the second adapter 7. Also, the protrusion portions formed on the first coupling portion 613 of the first adapter 6 are formed somewhat smaller than the depressions formed in the first diameter portion 501 of the hosel portion 5 such that the first adapter 6 does not interfere with the inner wall surface of the first diameter portion 501 regardless of the rotation position in which the first adapter 6 is fixed to the second adapter 7.

Accordingly, by changing the orientation in which the first adapter 6 is fitted into the hosel portion 5 so as to change the rotation position of the first adapter 6 relative to the hosel portion 5, the user can change the attachment angle of the shaft 20 relative to the head 10 so as to change the lie angle, the loft angle, and the face angle of the head 10. Also, by changing the rotation position of the second adapter 7 relative to the first adapter 6 while keeping the rotation position of the first adapter 6 fixed, the user can more finely change the lie angle, the loft angle, and the face angle of the head 10. Here, with the golf club 100 of the present embodiment, the user can attach the second adapter 7 in any rotation position. For this reason, with the golf club 100 of the present embodiment, the user can determine the attachment angle of the head 10 by selecting a desired combination from among countless combinations of a lie angle, a loft angle, and a face angle for the head 10.

At this time, the position indication portion 65 (see FIG. 3) indicating the rotation position is provided on the flange portion 612 of the first adapter 6, and is exposed to the outside. For this reason, the user can view the rotation position of the first adapter 6 without detaching the first adapter 6. Also, in the present embodiment, a portion of the interior space of the hosel portion 5 is exposed to the outside through the window 55. Specifically, a portion of the third diameter portion 503 of the hosel portion 5 is exposed to the outside, and a portion of the flange portion 72, which is provided with the position indication portion 722 (see FIG. 4) that indicates the rotation position of the second adapter 7, can be viewed from the outside. For this reason, the user can check the rotation position of the second adapter 7 without detaching the second adapter 7. Accordingly, with the golf club 100 of the present embodiment, the user can check the rotation position of the first adapter 6 and the rotation position of the second adapter 7 and thus check the lie angle, the loft angle, and the face angle of the golf club 100, without disassembling the coupling structure.

4. Variations

Although an embodiment of the present invention has been described above, the present invention is not limited to this embodiment, and various modifications can be made without departing from the gist of the invention. The following are examples of modifications that can be made.

4.1

Figure 10A:
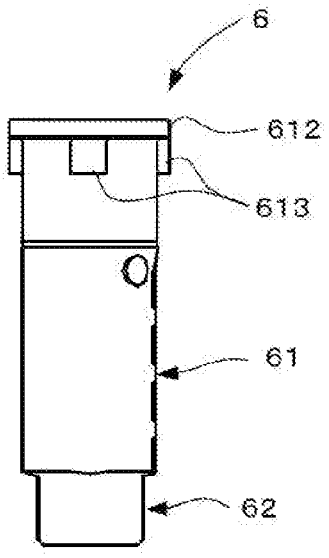
FIG. 10A is a side view of the first adapter according to another embodiment.
Figure 10B:
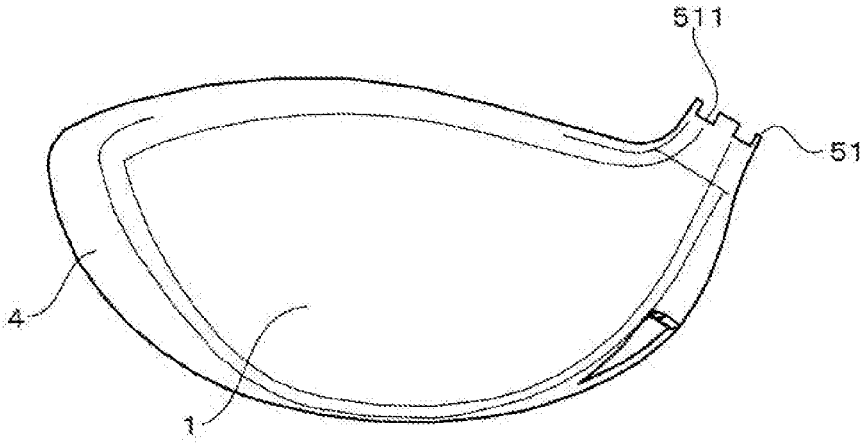
FIG. 10B is a side view of the golf club head according to the other embodiment.

In the above embodiment, multiple protrusion portions are formed on the first coupling portion 613 of the first adapter 6, and multiple depressions are formed in the first diameter portion 501 of the hosel portion 5, and thus the first adapter 6 and the hosel portion 5 are coupled so as to be incapable of axial rotation. However, the mode in which the first adapter 6 and the hosel portion 5 are coupled so as to be incapable of axial rotation is not limited to this mode, and various modes are possible. For example, although protrusion portions (first coupling portions 613) with a smaller diameter than the flange portion 612 of the first adapter 6 are provided in the above embodiment, protrusion portions 613 with the same diameter as the flange portion 612 may be provided below the flange portion 612 as shown in FIG. 10A. In this case, as shown in FIG. 10B, multiple cutout portions 511 into which the protrusion portions 513 fit are provided in the peripheral edge of the attachment hole 51 of the hosel portion 5. Even with this configuration, the first adapter 6 and the hosel portion can be coupled so as to be incapable of rotation. Alternatively, it is possible to provide protrusion portions that protrude in the axial direction on the peripheral edge of the attachment hole 51 of the hosel portion 5 and provide recessed portions into which the protrusion portions fit in the lower portion of the flange portion 612 of the first adapter. Alternatively, the first adapter 6 and the hosel portion 5 can have various configurations, as long as they can be detachably coupled so as to be incapable of rotation.

4.2

Also, in the above embodiment, the second adapter 7 is configured so as to be able to be fitted in any rotation position relative to the first adapter 6. However, the second adapter 7 need not be limited to this shape, and a rotation position that allows the second adapter 7 to fit into the first adapter 6 may be specified.

Figure 11A:
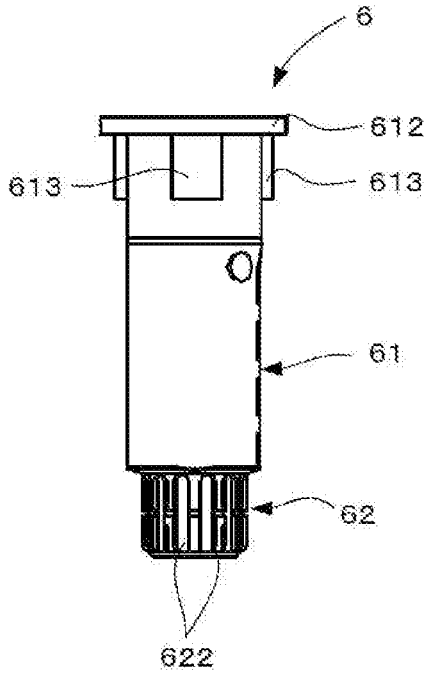
FIG. 11A is a side view illustrating the first adapter according to another embodiment.
Figure 11B:
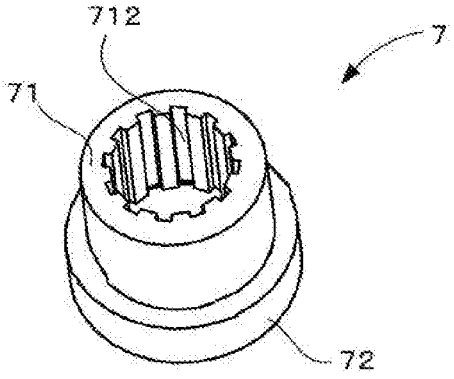
FIG. 11B is a perspective view illustrating the second adapter according to the other embodiment.

In this case, for example, as illustrated in FIG. 11A, the second coupling portion 62 of the first adapter 6 may be configured with an outer peripheral surface having formed thereon multiple projections 622 that extend in the first axis X1 direction. As illustrated in FIG. 11B, the recessed portion 711 of the second adapter 7 may be configured with an inner peripheral surface having formed thereon multiple grooves 712 that extend in the direction of the second axis Y2 of the second adapter and correspond to the projections 622 formed on the second coupling portion 62 of the first adapter 6, such that the grooves 712 receive the projections 622. At this time, the second coupling portion 62 and the recessed portion 711 are splined together, and therefore the first adapter 6 and the second adapter 7 are coupled so as to be incapable of axial rotation. Here, the first adapter 6 and the second adapter 7 can be coupled in the same number of rotation positions as the number of projections 622. Note that the number of projections 622 and grooves 712 is 2 to 12, for example, but there is no particular limitation on the number thereof.

In this way, by configuring the first adapter 6 and the second adapter 7 to be connected so as to be incapable of axial rotation, the rotation position in which the second adapter 7 can be fitted into the first adapter 6 is specified. Accordingly, the types of rotation positions that can be selected by the user are fixed, thus making it easier for the user to select a rotation position for the second adapter 7.

Note that in the above variation, the first adapter 6 and the second adapter 7 are coupled so as to be incapable of axial rotation due to the first adapter 6 and the second adapter 7 being splined together. However, the mode in which the first adapter 6 and the second adapter 7 are coupled about their axes need not be limited to this mode. For example, a configuration is possible in which the first adapter 6 and the second adapter 7 are coupled so as to be incapable of axial rotation due to forming the outer peripheral surface of the second coupling portion 62 of the first adapter 6 with a polygonal shape, and forming the recessed portion 711 of the second adapter 7 so as to have a polygonal inner wall surface that receives the second coupling portion 62.

4.3

Also, in the above embodiment, the second adapter 7 is configured so as to be able to be inserted in any rotation position relative to the hosel portion 5. However, the second adapter 7 need not be limited to this shape, and a rotation position that allows the second adapter 7 to be inserted into the interior space of the hosel portion 5 may be specified.

Figure 12:
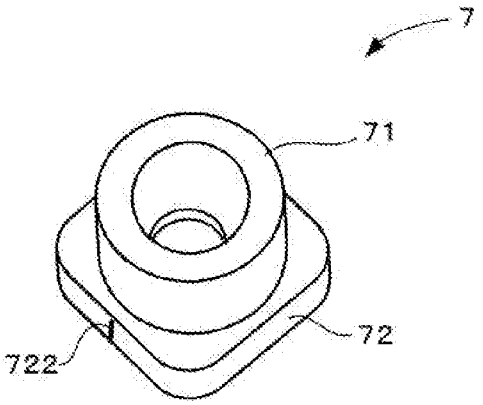
FIG. 12 is a perspective view illustrating the second adapter according to another embodiment.

In this case, for example, as illustrated in FIG. 12, the flange portion 72 of the second adapter 7 may be configured with an outer peripheral surface formed in a polygonal shape (a quadrangular shape in the figure). The third diameter portion 503 of the hosel portion 5 receiving the flange portion 72 may be configured with a polygonal inner wall surface so as to engage with the flange portion 72 of the second adapter 7. At this time, the polygonal outer peripheral surface of the flange portion 72 engages with the polygonal inner wall surface of the third diameter portion 503, and therefore the second adapter 7 and the hosel portion 5 are coupled so as to be incapable of axial rotation. Here, the second adapter 7 and the hosel portion 5 can be coupled in different rotation positions according to the shape of the flange portion 72. In the present embodiment, the flange portion 72 and the third diameter portion 503 are formed with a quadrangular column shape, and therefore the second adapter 7 can be inserted in the interior space of the hosel portion 5 in four types of rotation positions.

Configuring the second adapter 7 so as to be incapable of axial rotation relative to the hosel portion 5 in this way specifies the rotation positions in which the second adapter 7 can be fitted into the hosel portion 5. Accordingly, the types of rotation positions for the second adapter 7 that can be selected by the user are fixed, thus making it easier for the user to select a rotation position for the second adapter 7. Note that a configuration is possible in which the second adapter 7 is configured to be coupled to the first adapter 6 so as to be incapable of axial rotation as in the above variation, and also configured so as to be incapable of axial rotation relative to the hosel portion 5 as in the present variation.

Figure 13A:
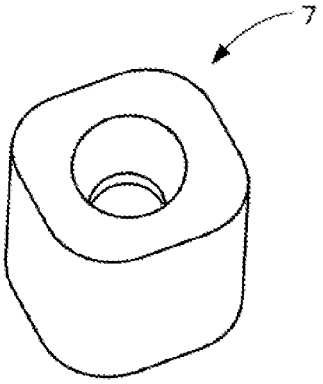
FIG. 13A is a perspective view illustrating the second adapter according to another embodiment.
Figure 13B:
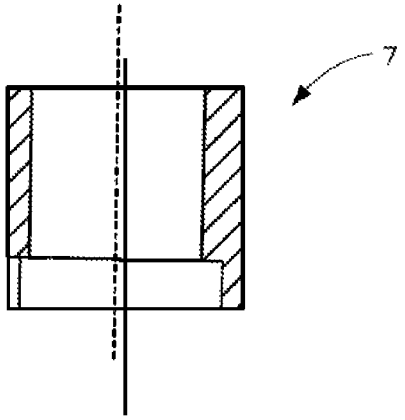
FIG. 13B is a cross-sectional view illustrating the second adapter according to the other embodiment.

Also, in the case of forming the second adapter 7 so as to be incapable of axial rotation relative to the hosel portion 5, the second adapter 7 may be formed in a polygonal column shape (a quadrangular column shape in the figures) as illustrated in FIGS. 13A and 13B. Specifically, rather than forming the second adapter 7 so as to have portions with different outer diameters, the second adapter 7 may be formed such that the outer diameter is constant. With the exception of the constant outer diameter being constant, this second adapter 7 is the same as the second adapter 7 described in the above embodiment and variations. In this variation, rather than providing the flange portion 72 (second coupling portion) separately, the entirety of the outer peripheral surface of the second adapter 7 is formed with a rectangular shape, and this outer peripheral surface corresponds to a second coupling portion of the second adapter in the present invention.

Figure 13C:
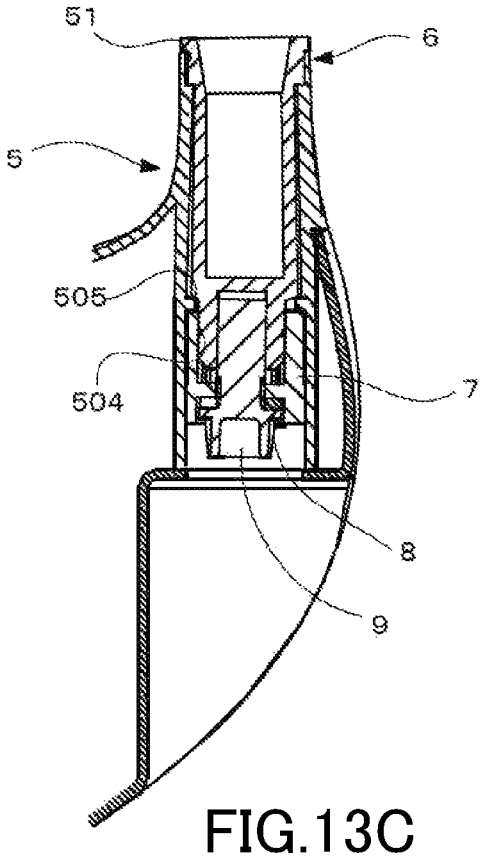
FIG. 13C is a cross-sectional view illustrating the golf club head with the second adapter of FIG. 13A (FIG. 13B) mounted thereto.

In this case, the interior space of the hosel portion 5 may be formed by an inner wall surface 504 that is rectangular and has a constant diameter, as illustrated in FIG. 13C. It should be noted that a flange portion 505 that extends radially inward may be provided on the inner wall surface 504 in order to prevent the first adapter 6 and the second adapter 7 from coming out of the interior space. Here, the upper end surface of the second adapter 7 and the step between the body portion 61 and the second coupling portion 62 of the first adapter 6 engage with the flange portion 505, thus fixing the first adapter 6 and the second adapter 7 so as to not come out of the interior space. In other words, the inner wall surface 504 and the flange portion 505 correspond to the hosel second coupling portion of the present invention. Note that the second adapter 7 may be formed with a circular column shape rather than a polygonal column shape.

4.4

Also, although the second coupling portion 62 of the first adapter 6 is formed as a cylindrical protruding portion, and a recessed portion 711 for reception thereof is formed in the second adapter 7 in the above embodiment, the coupling structure for the two adapters is not limited to this. For example, it is possible to form a tube-shaped protruding portion on the upper end portion of the second adapter 7, and form a recessed portion for receiving the protruding portion on the lower end portion of the first adapter 6.

4.5

In the above embodiment, the shaft 20 is inclined at an angle of 1 degree relative to the first adapter 6, and the first adapter 6 is inclined at an angle of 1 degree relative to the second adapter 7, but there are no particular limitations on these angles. Also, the two angles may be different.

4.6

Figure 14A:
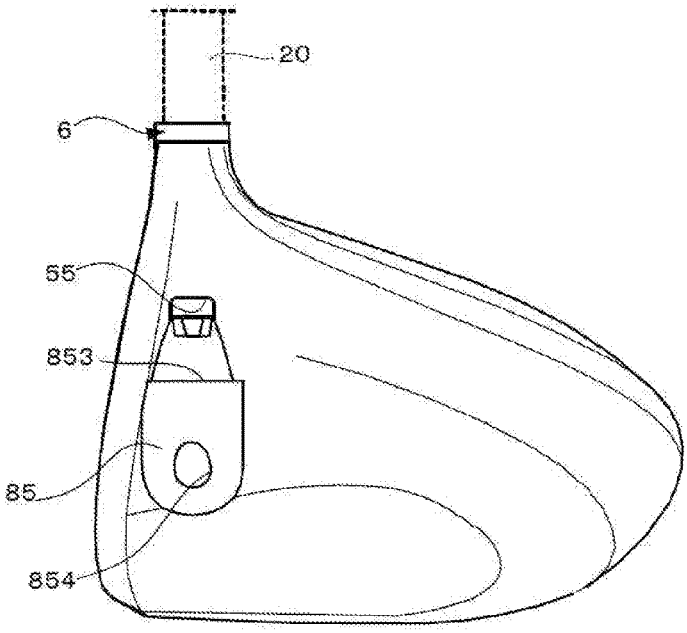
FIG. 14A is a front view illustrating the golf club head with a cap mounted thereto.
Figure 14B:
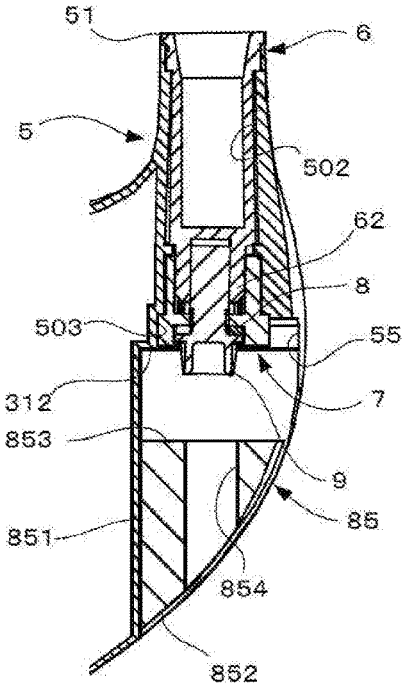
FIG. 14B is a cross-sectional view illustrating the golf club head with the cap mounted thereto.

The lower opening 313 in communication with the interior space is exposed via the recessed portion 31 formed in the surface of the golf club head 10 in the above embodiment, and a cap for blocking the recessed portion 31 may be provided. For example, as illustrated in FIGS. 14A and 14B, a cap 85 is formed by a side wall surface 851 that extends along the side surface 311 of the recessed portion 31, an outer wall surface 852 that extends along the outer peripheral surface of the golf club head 10, and an end surface 853 that opposes the base surface 312 of the recessed portion 31.

The length of the side wall surface 851 in the axial direction is shorter than that of the side surface 311 of the recessed portion 31, and thus a gap is formed between the base surface 312 of the recessed portion 31 and the end surface 853. Also, a through-hole 854 that extends in the axial direction is formed between the outer wall surface 852 and the end surface 853, and a tool such as a wrench can be inserted through this through-hole 54 from outside the cap 85. It is then possible to engage the tool with the head portion 91 of the fastener 9 and detach the fastener 9 while the cap 85 is closed. According to this configuration, the recessed portion 31 is blocked by the cap 85, thus making it possible to improve the designability of the head 10 and prevent loss of the fastener 9 when it is detached. Note that since a gap exists between the cap 85 and the base surface 312, the rotation position of the second adapter 7 can be changed by inserting a finger through the gap, for example. Accordingly, even if the cap 85 is attached, the rotation position of the second adapter 7 can be checked through not only the gap, but also through the window 55 formed in the surface of the head 10.

4.7

There are no particular limitations on the shape of the window 55, and as long as a cutout is formed in the inner wall surface of the interior space in the hosel portion 5, and the outer peripheral surface of the second adapter 7 can be checked, there are no particular limitations on the width, the axial length, the shape, and the like of the window. Also, the recessed portion 31 and the window 55 are not necessarily required to be in communication, and it is possible for them to be separated. In other words, the window 55 may be formed separately from the recessed portion 31 and the lower opening 313, and may be formed as an independent window in the surface of the head 10. Also, the window 55 can be made even larger so as to expose not only the second adapter 7 but also the position of coupling with the first adapter 6 to the outside. If a rotation position indicator is provided in the vicinity of the position at which the first adapter 6 is coupled to the second adapter 7, it is possible to observe the relationship between the rotation positions of the two adapters 6 and 7. Note that the window 55 is not necessarily required to be provided, and it is sufficient that the lower opening 313 capable of receiving at least the second adapter 7 is formed on the side of the head opposite to the attachment hole 51.

4.8

Figure 15:
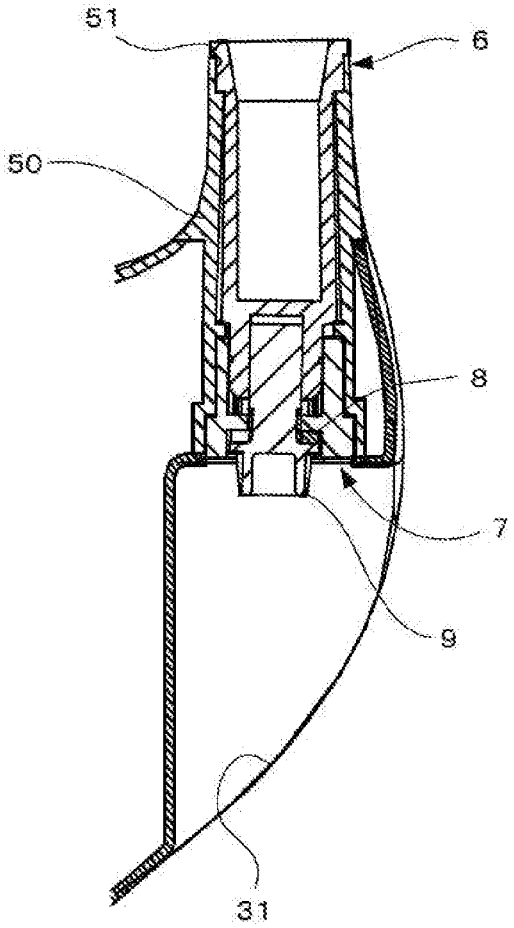
FIG. 15 is a cross-sectional view illustrating the golf club head according to another embodiment.

Although a portion of the head 10 forms the interior space in the hosel portion 5 in the above embodiment, the hosel portion 5 may be constituted by attaching a tube-shaped neck member 50 to the golf club head 10 as shown in FIG. 15, for example. For example, an attachment through-hole 21 that extends substantially parallel to the axial direction of the shaft is formed at a position in the golf club head 10 where the hosel portion 5 is to be formed (a position on the heel side of the crown portion 2). This attachment through-hole 21 extends toward the sole portion 3 side. Also, the above-described recessed portion 31 is formed in a portion of the sole portion 3 on the side opposite to the hosel portion 5.

Figure 16A:
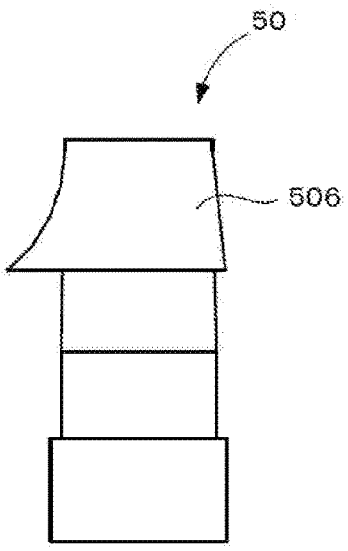
FIG. 16A is a front view illustrating a neck member.
Figure 16B:
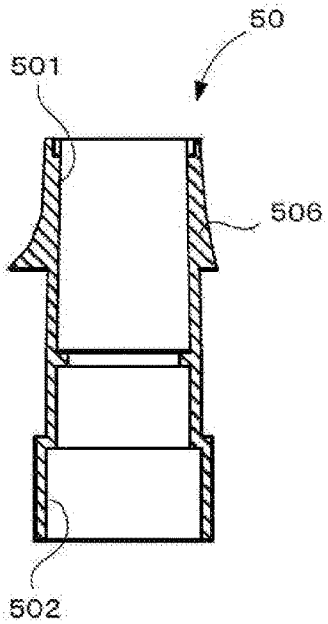
FIG. 16B is a cross-sectional view illustrating the neck member.

The neck member 50 is fixed in the thus-formed attachment through-hole 21 as illustrated in FIGS. 16A and 16B. Similarly to the hosel portion 5 of the above embodiment, the neck member 50 is constituted by a first diameter portion 501, a second diameter portion 502, and a third diameter portion 503. Also, a flange portion 506 is formed on the outer peripheral surface of the first diameter portion 501 and the second diameter portion 502, and engages with the peripheral edge of the opening of the attachment through-hole 21 on the crown portion 2 side. The portion of the neck member 50 below the flange portion 506 is then inserted into the attachment through-hole 21, and the neck member 50 is fixed such that the opening on the lower end portion side of the third diameter portion 503 coincides with the lower opening 313. In this way, the interior space of the hosel portion 5 is formed by the neck member 50, and the opening of the first diameter portion 501 on the upper end portion side constitutes the attachment hole 51 of the hosel portion 5.

4.9

Figure 17:
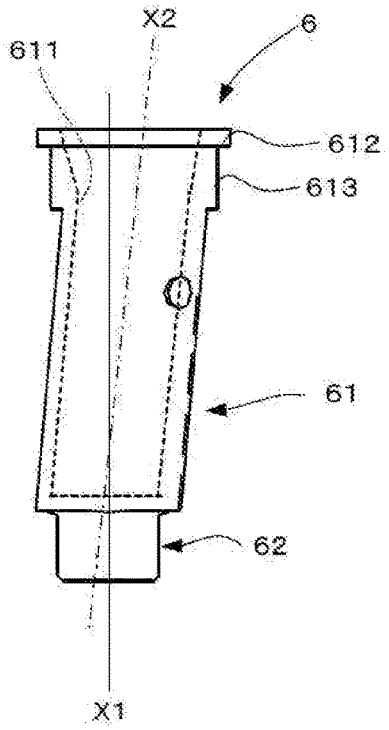
FIG. 17 is a side view illustrating the first adapter according to another embodiment.

In the above embodiment, the outer peripheral surface of the first adapter 6 is formed to be parallel with the first axis X1, and the shaft receiving recessed portion 611 is formed along the second axis X2 that intersects the first axis X1. However, the first adapter 6 is not limited to this shape, and may be formed as illustrated in FIG. 17, for example. As illustrated in this figure, in this example, the body portion 61 of the first adapter 6 is formed to be inclined relative to the second coupling portion 62. Specifically, in this example, the second coupling portion 62 is formed along the first axis X1, and the outer peripheral surface of the body portion 61 is formed along the second axis X2. Also, the shaft receiving recessed portion 611 formed in the body portion 61 is also formed so as to extend along the second axis X2. Even when the first adapter 6 is configured in this way, the axial center S of the shaft 20 follows the second axis X2, and therefore the shaft 20 can be fixed at an inclination relative to the first adapter 6. Note that in order for the entirety of the flange portion 612 to come into contact with the attachment hole 51 of the hosel portion 5, the flange portion 612 is formed so as to be inclined relative to the body portion 61.

4.10

Figure 18:
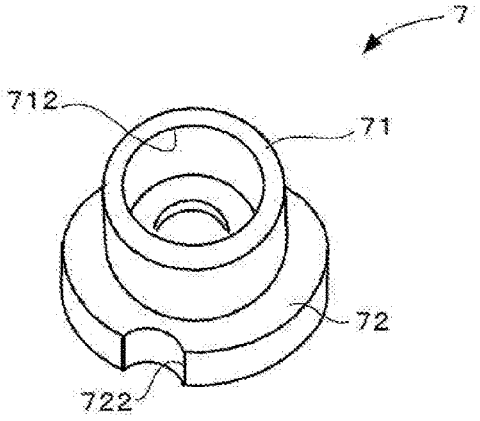
FIG. 18 is a perspective view illustrating the second adapter according to another embodiment.

Also, although the position indication portion 65 of the first adapter 6 and the position indication portion 722 of the second adapter 7 indicate the rotation positions with lines in the above embodiment, they may indicate the rotation positions with something else, such as figures or numbers. Also, the position indication portion 65 of the first adapter 6 and the position indication portion 722 of the second adapter 7 may indicate the rotation positions with a method such as providing protruding portions by processing (e.g., cutting out (see FIG. 18)) portions of the first adapter 6 and the second adapter 7. FIG. 18 shows an example in which cutouts are used as the position indication portion 722. Note that there are no particular distinctions between the position indication portion 65 and the reference indicator 52, and there are no particular limitations on them as long as rotation position alignment can be performed. In other words, it is sufficient that some sort of indicator is provided, and it is possible to provide the reference indicator on the first adapter 6 and provide the position indication portion on the second adapter 7.

4.11

Figure 19A:
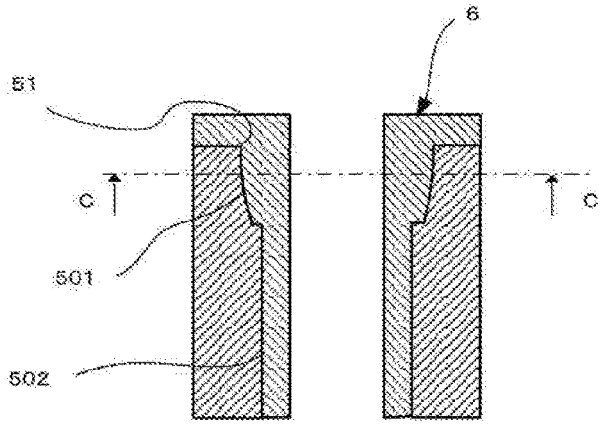
FIG. 19A is a cross-sectional view illustrating a state of the inside of the hosel according to another embodiment.
Figure 19B:
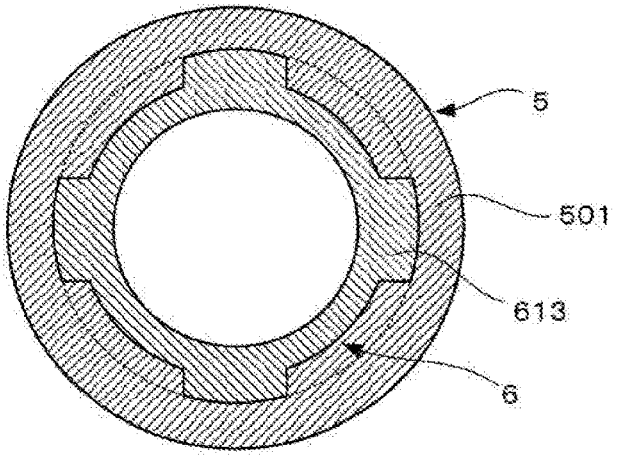
FIG. 19B illustrates a cross-section taken along line C-C in FIG. 19A.
Figure 19C:
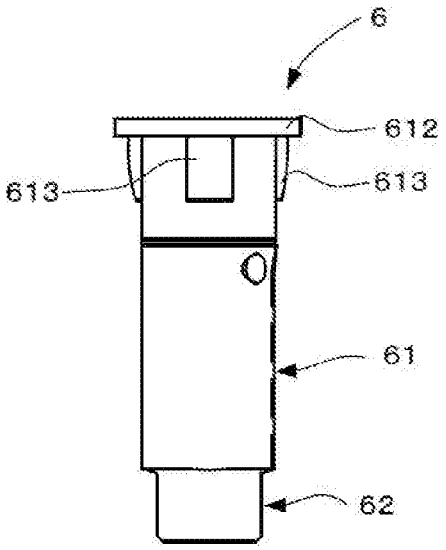
FIG. 19C is a side view illustrating the first adapter according to the other embodiment.

Also, in the above embodiment, the depressions in the first diameter portion 501 of the hosel portion 5 and the protrusion portions on the first coupling portion 613 of the first adapter 6 are formed with rectangular shapes. However, the depressions in the first diameter portion 501 and the protrusion portions on the first coupling portion 613 are not limited to this shape, and may be formed as illustrated in FIGS. 19A to 19C, for example. In the example illustrated in FIGS. 19A to 19C, the inner peripheral surface of the depressions in the first diameter portion 501 and the outer peripheral surface of the protrusion portions on the first coupling portion 613 are formed so as to be spherical on the contact surface in the direction perpendicular to the axis and protrude in the direction perpendicular to the axis. Accordingly, it is possible to improve the force of adhesion between the hosel 5 and the first adapter 6.

Figure 20A:
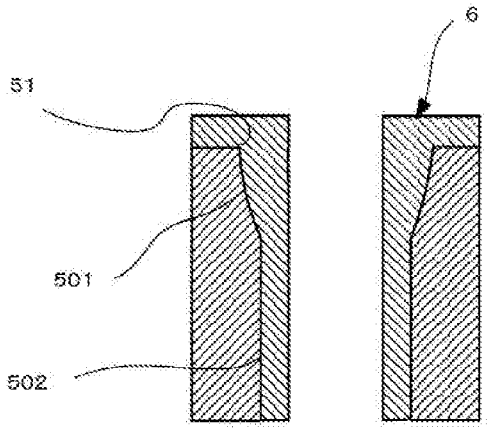
FIG. 20A is a cross-sectional view illustrating a state of the inside of the hosel according to another embodiment.
Figure 20B:
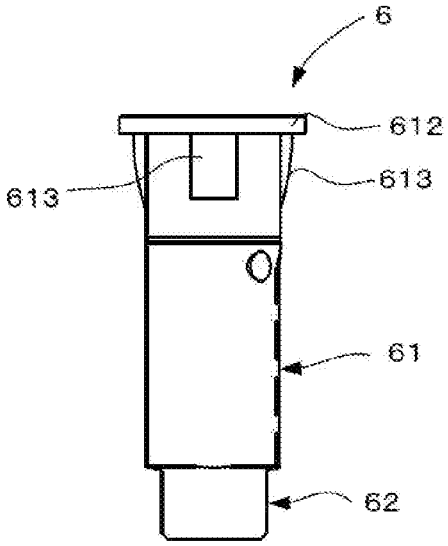
FIG. 20B is a side view illustrating the first adapter according to the other embodiment.

Note that as illustrated in FIGS. 19A and 19C, the spherical contact surfaces of the depressions in the first diameter portion 501 and the protrusion portions on the first coupling portion 613 do not need to be continuous with the contact surfaces of the second diameter portion 502 and the body portion 61. In this case, the depressions in the first diameter portion 501 and the protrusion portions on the first coupling portion 613 are formed such that a step is provided in the connection portion between the first diameter portion 501 and the second diameter portion 502. Also, as illustrated in FIGS. 20A and 20B, the spherical contact surfaces of the depressions in the first diameter portion 501 and the protrusion portions on the first coupling portion 613 may be continuous with the contact surfaces of the second diameter portion 502 and the body portion 61. In this case, the depressions in the first diameter portion 501 and the protrusion portions on the first coupling portion 613 are formed such that the first diameter portion 501 and the second diameter portion 502 are continuous, without the formation of a step.

4.12

Note that since the golf club head configured as described above is a hollow structure, it can be manufactured by joining two or more members together. Specifically, it can be manufactured by joining together a head body provided with one or two or more openings in communication with a hollow portion, and a separate member that blocks these openings. For example, it is possible to constitute the head by constituting only the crown portion 2 and the face portion 1 as separate members and combining them with the head body, or forming the head body such that an opening is provided in the sole portion 3 and the side portion 4 and blocking this opening with a separate member. Also, this head body can be manufactured by casting using a known lost-wax precision casting method, for example.

The invention claimed is:

1. A golf club comprising:

a shaft;

a golf club head having a hosel portion for attachment of the shaft that includes an attachment hole with upper and lower ends that extends through an interior space of the hosel portion, a hosel first coupling portion provided on a peripheral edge of the upper end of the attachment hole, a hosel second coupling portion provided on the lower end of the attachment hole, and a first opening portion disposed at the lower end of the attachment hole;

a first adapter that is accommodated in the interior space of the hosel portion from the upper end of the attachment hole having a first upper end portion that is open with a shaft receiving recessed portion and a second lower end portion, a first coupling portion that is provided on a first upper end portion side and is coupled to the hosel first coupling portion of the golf club head so as to be incapable of axial rotation, and a second coupling portion provided on a second lower end portion side;

a second adapter that is accommodated in the interior space of the hosel portion from a first opening portion side having a first upper end portion and a second lower end portion, a first coupling portion that is provided on the first upper end portion side and is coupled to the second coupling portion of the first adapter, and a second coupling portion that is coupled to the hosel second coupling portion of the golf club head; and a fixing member that detachably fastens together the first adapter and the second adapter from the lower second end portion side of the second adapter, wherein the second coupling portion of the first adapter has a cylindrical bore formed along a first axis, and the shaft receiving recessed portion of the first upper end portion of the first adapter has a cylindrical bore formed along a second axis that intersects the first axis of the first adapter, such that the shaft is fixed to the shaft receiving recessed portion so as to be inclined relative to the second coupling portion of the first adapter, the second coupling portion of the second adapter has a cylindrical bore formed along a first axis, and the first coupling portion of the second adapter has a cylindrical bore formed along a second axis that intersects the first axis of the second adapter, such that the second coupling portion of the first adapter is coupled to the first coupling portion of the second adapter so as to be inclined relative to the second coupling portion of the second adapter, the first coupling portion of the first adapter and the hosel first coupling portion of the golf club head can be detachably coupled in a plurality of rotational positions, and the second coupling portion of the first adapter and the first coupling portion of the second adapter can be detachably coupled in a plurality of rotation positions, wherein a second opening portion that is in communication with the interior space of the hosel portion and exposes at least a portion of an outer peripheral surface of the second adapter to the outside is formed in a front surface of the golf club head, and a position indication portion for indicating a rotational position is provided on a portion of the second adapter that is exposed through the second opening portion.

2. The golf club according to claim 1, wherein the first adapter is formed with a tube shape along the first axis of the first adapter such that the first upper end portion and the second lower end portion of the first adapter are located on the first axis of the first adapter, the second adapter is formed with a tube shape along the first axis of the second adapter such that the first upper end portion and the second lower end portion of the second adapter are located on the first axis of the second adapter, the first coupling portion of the first adapter and the hosel first coupling portion can be coupled in a plurality of rotation positions about the first axis of the first adapter, and the second coupling portion of the first adapter and the first coupling portion of the second adapter can be coupled in a plurality of rotation positions about the second axis of the second adapter.

3. The golf club according to claim 2, wherein the second coupling portion of the first adapter is configured by an outer peripheral surface having formed thereon a plurality of projections that extend in a direction of the first axis of the first adapter, the first coupling portion of the second adapter is configured by an inner peripheral surface having formed therein a plurality of grooves that extend in a direction of the second axis of the second adapter and correspond to the plurality of projections so as to receive insertion of the plurality of projections, and the second coupling portion of the first adapter and the first coupling portion of the second adapter can be coupled so as to be incapable of axial rotation in a plurality of rotation positions due to engagement of the plurality of projections of the first adapter and the plurality of grooves of the second adapter.

4. The golf club according to claim 3, wherein the second coupling portion of the second adapter is configured by an outer peripheral surface formed with a polygonal shape, and the hosel second coupling portion of the golf club head is configured by a polygonal inner wall surface on the first opening portion side so as to receive and engage with the second coupling portion of the second adapter, such that the second coupling portion of the second adapter and the hosel second coupling portion of the golf club head can be coupled so as to be incapable of axial rotation.

5. The golf club according to claim 4, further comprising a cover member that detachably closes the first opening portion.

6. The golf club according to claim 5, wherein a through-hole for insertion of a tool that can operate the fixing member is formed in the cover member.

7. The golf club according to claim 6, wherein the first adapter further has a position indication portion for indicating a rotation position on the first end portion side of the first adapter.

8. The golf club according to claim 1, wherein the first adapter is formed with a tube shape along the first axis of the first adapter such that the first upper end portion and the second lower end portion of the first adapter are located on the first axis of the first adapter, the second adapter is formed with a tube shape along the first axis of the second adapter such that the first upper end portion and the second lower end portion of the second adapter are located on the first axis of the second adapter, the first coupling portion of the first adapter and the hosel first coupling portion can be coupled in a plurality of rotation positions about the first axis of the first adapter, and the second coupling portion of the first adapter and the first coupling portion of the second adapter can be coupled in a plurality of rotation positions about the second axis of the second adapter.

9. The golf club according to claim 8, wherein the second coupling portion of the first adapter is configured by an outer peripheral surface having formed thereon a plurality of projections that extend in a direction of the first axis of the first adapter, the first coupling portion of the second adapter is configured by an inner peripheral surface having formed therein a plurality of grooves that extend in a direction of the second axis of the second adapter and correspond to the plurality of projections so as to receive insertion of the plurality of projections, and the second coupling portion of the first adapter and the first coupling portion of the second adapter can be coupled so as to be incapable of axial rotation in a plurality of rotation positions due to engagement of the plurality of projections of the first adapter and the plurality of grooves of the second adapter.

10. The golf club according to claim 1, wherein the second coupling portion of the first adapter is configured by an outer peripheral surface having formed thereon a plurality of projections that extend in a direction of the first axis of the first adapter, the first coupling portion of the second adapter is configured by an inner peripheral surface having formed therein a plurality of grooves that extend in a direction of the second axis of the second adapter and correspond to the plurality of projections so as to receive insertion of the plurality of projections, and the second coupling portion of the first adapter and the first coupling portion of the second adapter can be coupled so as to be incapable of axial rotation in a plurality of rotation positions due to engagement of the plurality of projections of the first adapter and the plurality of grooves of the second adapter.

11. The golf club according to claim 1, wherein the second coupling portion of the second adapter is configured by an outer peripheral surface formed with a polygonal shape, and the hosel second coupling portion is configured by a polygonal inner wall surface on a first opening portion side so as to receive and engage with the second coupling portion of the second adapter, such that the second coupling portion of the second adapter and the hosel second coupling portion of the golf club head can be coupled so as to be incapable of axial rotation.

12. The golf club according to claim 1, further comprising a cover member that detachably closes the first opening portion.

13. The golf club according to claim 12, wherein a through-hole for insertion of a tool that can operate the fixing member is formed in the cover member.

14. The golf club according to claim 1, wherein the first adapter further has a position indication portion for indicating a rotation position on the first end portion side of the first adapter.

* * * * *